US005390722A

United States Patent [19]

Ashok et al.

[11] Patent Number: 5,390,722

[45] Date of Patent: Feb. 21, 1995

[54] SPRAY CAST COPPER COMPOSITES

[75] Inventors: Sankaranarayanan Ashok, Bethany; William G. Watson, Cheshire; Harvey P. Cheskis, North Haven, all of Conn.

[73] Assignee: Olin Corporation, New Haven, Conn.

[21] Appl. No.: 11,450

[22] Filed: Jan. 29, 1993

[51] Int. Cl.[6] ..... B22D 19/14

[52] U.S. Cl. ..... 164/46; 164/97; 164/461

[58] Field of Search ..... 164/46, 97, 461

[56] References Cited

U.S. PATENT DOCUMENTS

| | | | |
|---|---|---|---|
| Re. 31,767 | 12/1984 | Brooks . | |
| 2,123,628 | 7/1938 | Hensel et al. . | |
| 4,207,096 | 6/1980 | Suwa et al. | 164/97 |
| 4,804,034 | 2/1989 | Leatham et al. . | |
| 4,907,639 | 3/1990 | Ashok et al. . | |
| 4,917,170 | 4/1990 | Sankaranarayanan et al. . | |
| 4,925,103 | 5/1990 | Muench et al. . | |
| 4,926,927 | 5/1990 | Watson et al. . | |
| 4,938,278 | 7/1990 | Sankaranarayanan et al. . | |
| 4,945,973 | 8/1990 | Ashok et al. . | |
| 4,960,752 | 10/1990 | Ashok et al. . | |
| 4,961,457 | 10/1990 | Watson et al. . | |
| 4,966,224 | 10/1990 | Cheskis et al. . | |
| 4,971,133 | 11/1990 | Ashok et al. . | |
| 4,977,950 | 12/1990 | Muench . | |
| 5,017,250 | 5/1991 | Ashok . | |
| 5,120,612 | 6/1992 | Ashok . | |
| 5,137,685 | 8/1992 | McDevitt et al. . | |

FOREIGN PATENT DOCUMENTS

| | | |
|---|---|---|
| 88305050 | 12/1988 | European Pat. Off. . |
| 60-152644 | 1/1984 | Japan . |
| 2172900A | 10/1986 | United Kingdom . |
| PCT/GB88/-1106 | 6/1989 | WIPO . |

*Primary Examiner*—Kuang Y. Lin

*Attorney, Agent, or Firm*—Gregory S. Rosenblatt

[57] ABSTRACT

There is disclosed methods for the manufacture of a metal matrix composite having a metal or metal alloy matrix and a uniform dispersion of a second phase. The second phase is either a refractory metal or a nonmetal. An element which reacts with both the matrix and the second phase is added to increase the loathing density of the second phase and to improve adhesion between the components of the composite. When the metal alloy matrix is copper or a copper based alloy, suitable reactive elements include zirconium, titanium, chromium and mixtures thereof.

10 Claims, 4 Drawing Sheets x100 x1000

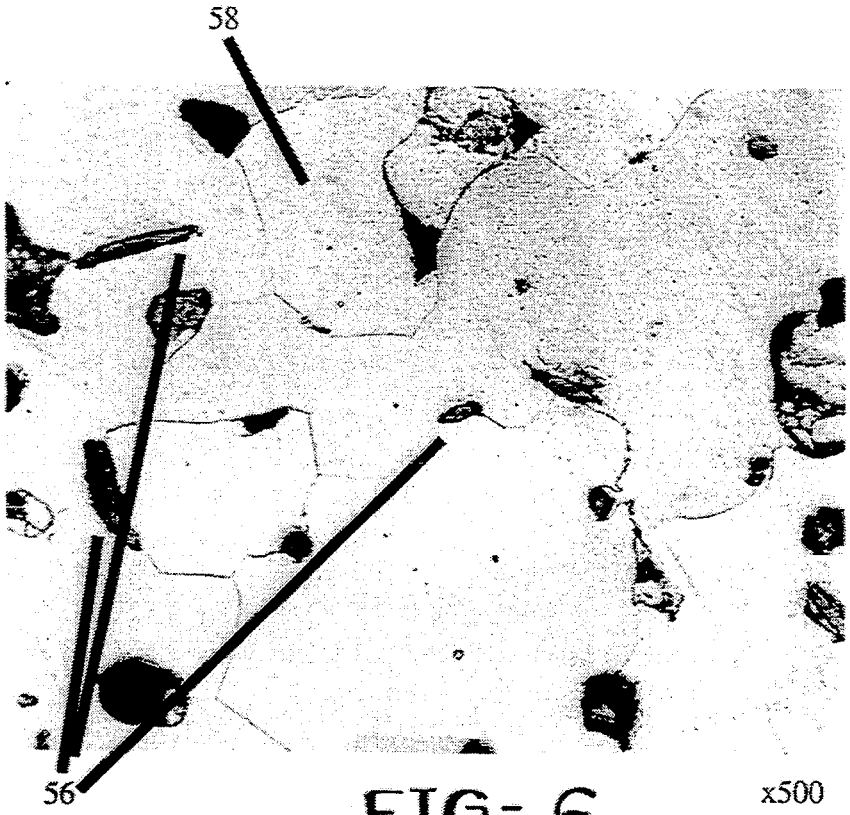
FIG- 6 x500
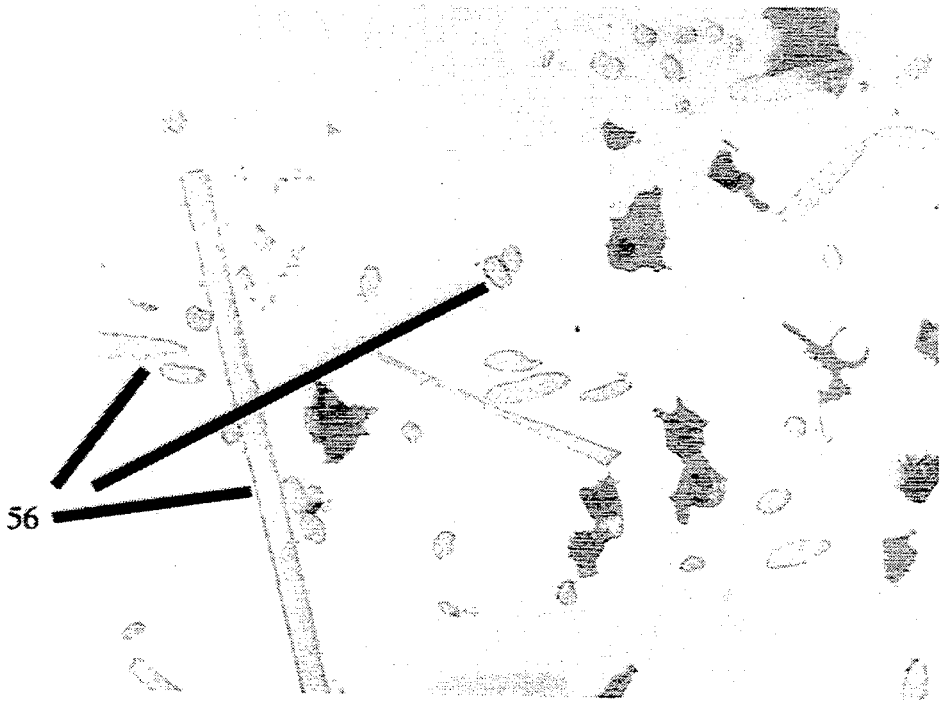
FIG- 7 x500

SPRAY CAST COPPER COMPOSITES

BACKGROUND OF THE INVENTION

This invention relates generally to spray cast metal matrix composites. More particularly, a copper or copper alloy matrix is interdispersed with a refractory metal or nonmetallic second phase during spray casting. Adhesion between the matrix and the second phase is enhanced by the addition of a reactive metal.

Metal matrix composites, having a metallic matrix and a second phase uniformly dispersed throughout the matrix can be tailored with unique properties. Some examples of these properties include second phase carbon or ceramic fibers to increase the stiffness and strength while reducing weight and the addition of second phase refractory metals to influence the coefficient of thermal expansion or softening resistance.

Differences in density, melting temperature and reactivity between the metallic matrix and the second phase make it difficult to form certain composites by conventional casting means. One casting method which has proven successful is spray casting. Spray casting is a method to manufacture metallic articles directly to a desired shape. The basic spray casting process comprises:

1. Atomizing a fine stream of molten metal.
2. Rapidly cooling the atomized droplets in flight so that the droplets are either at or near the solidification temperature.
3. Depositing the droplets on a collector. The collector is sometimes chilled to promote rapid solidification upon impact. Further, the collector moves in a predetermined pattern to generate a metal preform having a desired shape.
4. Optionally, working or directly machining the preform to generate the final shape and/or properties required.

The spray casting process is generally known as the Osprey Process and is more fully disclosed in U.S. Pat. Nos. RE 31,767 and 4,804,034, as well as United Kingdom Patent No. 2,172,900A, all assigned to Osprey Metals Ltd., of Neath, Wales.

The manufacture of composites by spray casting is disclosed in International Patent Application PCT/GB 88/01106 by Osprey Metals, Ltd. A metallic matrix is atomized by impinging a liquid metal stream with a high pressure gas. Second phase particles are added either to the liquid stream or to the post atomization divergent cone of metallic droplets. One example disclosed is atomizing titanium and adding 10 micron particles of silicon carbide. The titanium reacts with the silicon carbide precipitating titanium carbide dispersoids in a titanium matrix.

European Patent Application 88 305 050.2 by Alcan International, Ltd., discloses the manufacture of a metal matrix composite. The matrix is an aluminum/lithium alloy and the second phase is a particulate with an aspect ratio of less than 5:1. Disclosed second phases are silicon carbide, alumina and boron carbide. The metallic matrix is atomized and the second phase injected either into the melt or the droplets following atomization.

U.S. Pat. No. 5,120,612 by Ashok, discloses spray cast composite metals. The alloy matrix is a copper based alloy and the second phase is a nonmetallic refractory such as silicon carbide, alumina, titanium nitride, titanium oxide, titanium carbide or zirconium boride. The second phase is introduced as a solid into the atomized droplets. A reactive element such as zirconium, chromium or titanium is added to the metallic melt to improve the bond between the nonmetallic particles and the copper alloy matrix. U.S. Pat. No. 5,120,612 is incorporated by reference herein in its entirety.

While it is known to manufacture metal matrix composites by spray casting, several problems exist. The reactive elements may react with the walls of the furnace used to cast the melt, form excessive dross, or oxidize. Further, spray casting has proven generally unsuccessful for incorporating small and/or low density particles due to static electric clumping of the particles and low inertial momentum. Attempts to insert graphite particles into a copper alloy matrix by conventional spray casting means has been limited to about 1% by volume due to the aforementioned problems.

It is therefore Applicants' objective to provide a method for spray casting a metal matrix composite which does not have the problems of the prior art.

SUMMARY OF THE INVENTION

Accordingly, it is an object of the invention to develop a method for spray casting a metal matrix composite in which the second phase is a refractory metal or nonmetal. It is a feature of the invention that a reactive metal is added either to the molten metal matrix or to the second phase particles prior to atomization. In preferred embodiments of the invention, the reactive metal is added to the second phase, rather than the molten metal matrix. Yet another feature of the invention is that the volume fraction of the second phase may be increased by a factor of over 100%.

It is an advantage of the invention that metal matrix composites having a second phase refractory metal are produced by spray casting. By adding a reactive metal to the second phase rather than to the molten metal matrix, erosion of the furnace walls, dross formation and oxidation is reduced. Another advantage of the invention is that low density second phase particles may be incorporated into the metal matrix in high volume.

In accordance with the invention, there is provided a method for producing a metal matrix composite. The method comprises the steps of melting a first constituent containing a metal or metallic alloy. The first constituent is then atomized into a stream of droplets. A second constituent is injected into the stream of droplets. The second constituent contains both desired second phase particles and a reactive metal.

The above stated objects, features and advantages will be become more apparent from the specification and drawings which follow.

BRIEF DESCRIPTION OF THE DRAWINGS

FIG. 6 is a micrograph of a copper alloy matrix having 1% by volume graphite particles.

FIG. 7 is a micrograph of a copper alloy matrix with 8% by volume graphite particles as produced by the method of the present invention.

DETAILED DESCRIPTION

Figure 1:
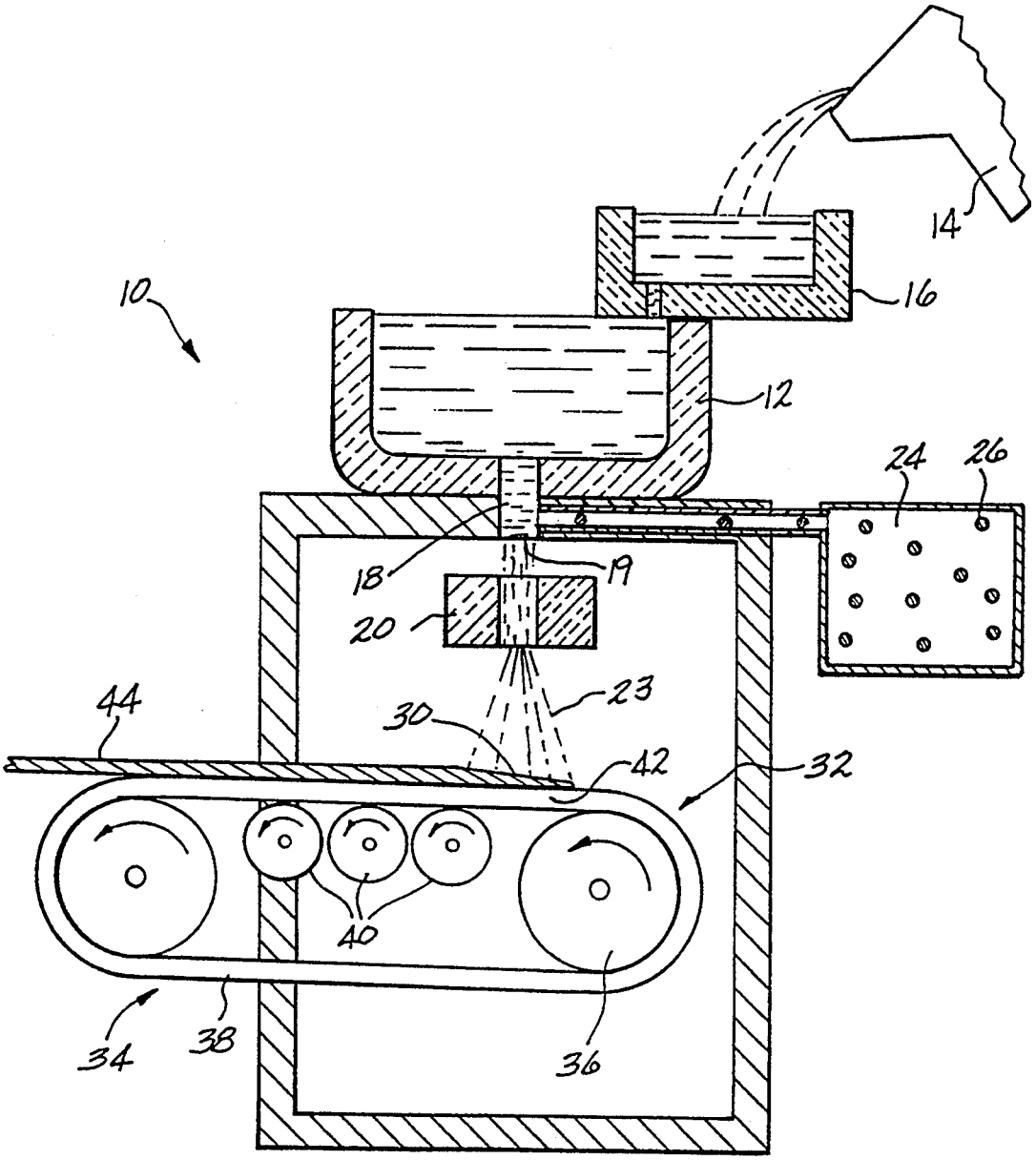
FIG. 1 shows in cross-sectional representation a spray casting apparatus as utilized for the present invention.

The spray cast metal matrix composites of the invention have, as a first constituent, a metal or metallic alloy matrix and either a refractory metal, refractory metal alloy or nonmetal, as a second constituent. A reactive element, which reacts with both the first and second constituents, enhances adhesion between the constituents and increases the volume fraction of the second constituent which is incorporated into the matrix. FIG. 1 shows in cross-sectional representation a spray deposition apparatus 10 for generating a continuous strip of the metal matrix composites of the invention. A tundish 12 receives molten metal from a tiltable melt furnace 14 via a transfer lauder 16. The molten metal contained within the tiltable melt furnace 14 may be either the first constituent metallic matrix or the first constituent metallic matrix plus a reactive element. As will become apparent hereinbelow, in preferred embodiments of the invention, the tiltable melt furnace 14 contains only the metallic matrix constituents.

The tundish 12 includes a bottom nozzle 18 through which the molten first constituent issues in a continuous stream 19. A gas atomizer 20 is supplied with a gas under pressure from any suitable source. The gas should preferably not react with the molten metal matrix and is most preferably nitrogen. The nitrogen should have a very low concentration of oxygen to avoid the formation of oxides. The atomization gas is impinged against the molten first constituent under pressure to produce a stream of droplets 23 having a mean particle size within a desired range. While the gas pressure will vary, typically from about 2.1 $kg/cm^2$ to about 10.5 $kg/cm^2$ (30–150 psi), dependent on the diameter of the molten stream and the diameter of the atomizing orifice, a gas to metal ratio of from about 0.24 $m^3/kg$ to about 1.0 $m^3/kg$ has been found to produce droplets having a mean diameter size of up to about 500 microns. A preferred mean droplet diameter size is from about 50 to about 250 microns.

A source 24 of second constituents injects the second phase particles 26 by means of conduit 28 into the stream of droplets 23 at a point in the vicinity of the point of impingement of the atomizing gas with the molten stream. Preferably, the injection site is within from about 5 centimeters above the point of inpingement to about 2 centimeters below the point of inpingement. Injection of the second constituent is driven by pressurized gas. While any gas which is nonreactive with the first and second constituents may be utilized, it is preferred to utilize the atomization gas. The injection pressure is from about 0.7 $kg/cm^2$ to about 3.5 $kg/cm^2$ (10–50 psi). The rate of particle injection is controlled by the injection gas flow utilizing aspiration or levitation.

Figure 2:
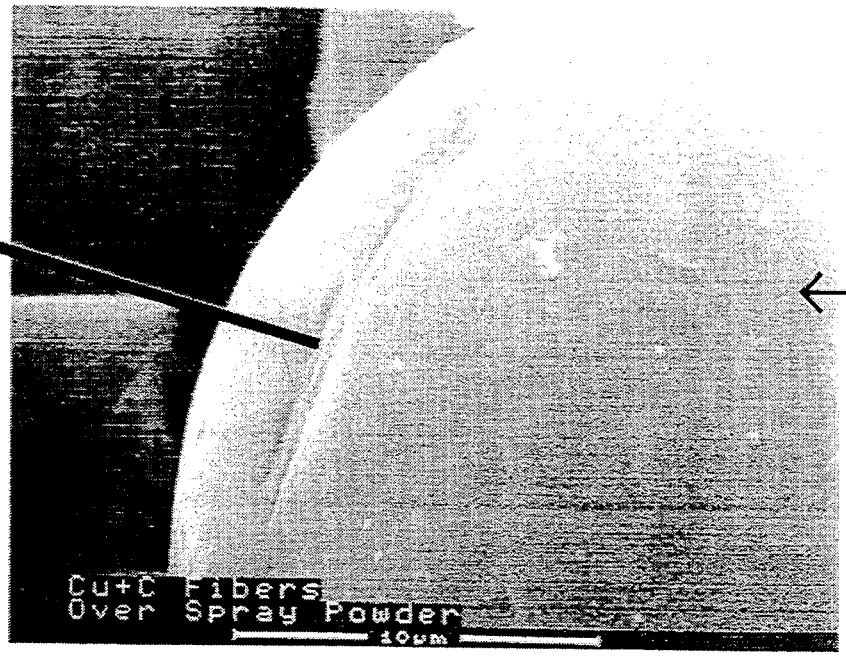
FIG. 2 is a micrograph of a copper droplet which did not effectively wet a carbon fiber.

The second phase particles have an average size of below about 100 microns. More preferably, the average size of the second phase particles is below about 45 microns. When the second phase particles 26 enter the diverging cone of droplets 23, it is desired that the particles 26 uniformly disperse and adhere to the droplets. When this occurs, a spray cast deposit 30 having a uniform dispersion of second phase particles accumulates at the collector 32. However, as illustrated in FIG. 2, the second phase particles do not readily adhere to the droplets due to unfavorable surface energy effects. The figure illustrates a solidified copper droplet 50 recovered from the spray casting apparatus. A deformation 52 on the surface of the solidified copper droplet 50 indicates that a carbon fiber from the second constituent source had impacted the droplet, but did not adhere.

Figure 3:
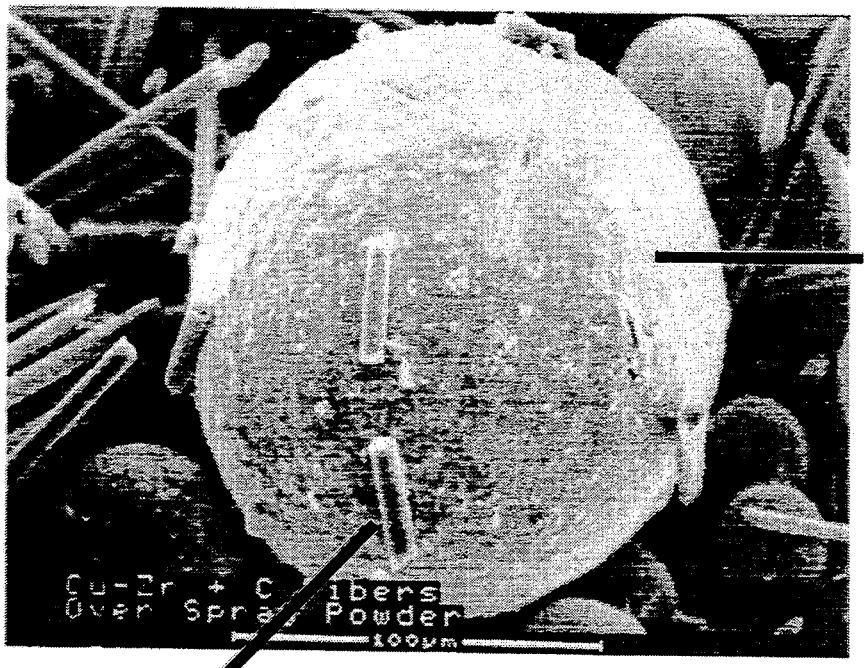
FIG. 3 is a micrograph of a copper droplet which effectively wet a carbon fiber.

The addition of a reactive metal, in the illustrated example zirconium, in accordance with the invention enhances the wettability of the copper based droplet as illustrated in FIG. 3. The solidified droplet 50' has many carbon fibers 54 adherent thereto. When a droplet such as this impacts the collector and splats, a uniform dispersion of carbon fibers is obtained. When the first constituent is copper or a copper based alloy, suitable reactive elements include zirconium, chromium and titanium.

Addition of small amounts of the reactive element to copper promotes both enhanced wetting of refractory metal or nonmetallic second phase and excellent bonding at the copper alloy/refractory metal or nonmetal interface.

One group of second phase particles are refractory metals, including tungsten, molybdenum, tantalum, vanadium and niobium as well as mixtures thereof. Another suitable group is refractory metal alloys such as ferrotungsten and ferrovanadium. The addition of these refractory metals in powder form to a copper alloy matrix improves high temperature properties such as resistance to stress relaxation. The refractory metals have a particle size of from about 1 to about 100 microns and more preferably from about 5 to about 50 microns. The refractory metal second phases can also be used to tailor the thermal expansion of the composite and can create fiber composites by application of large amounts of deformation, such as by rolling, after spray casting. These property improvements require that a tenacious bond be formed at the interface of the first and second phases.

One preferred composite having high thermal conductivity and a relatively low coefficient of thermal expansion comprises a copper alloy matrix, such as copper-zirconium and dispersed tungsten particles as the second phase.

The reactive element may be added to the melt furnace as described in U.S. Pat. No. 5,120,612. However, the reactive element may react with oxygen to form dross which must be continuously skimmed from the surface of the tilt furnace. Additionally, the reactive element can react with the ceramic or graphite walls of the furnace, leading to wall erosion. Reactive metals such as zirconium readily oxidize and the beneficial effects are lost.

Figure 4:
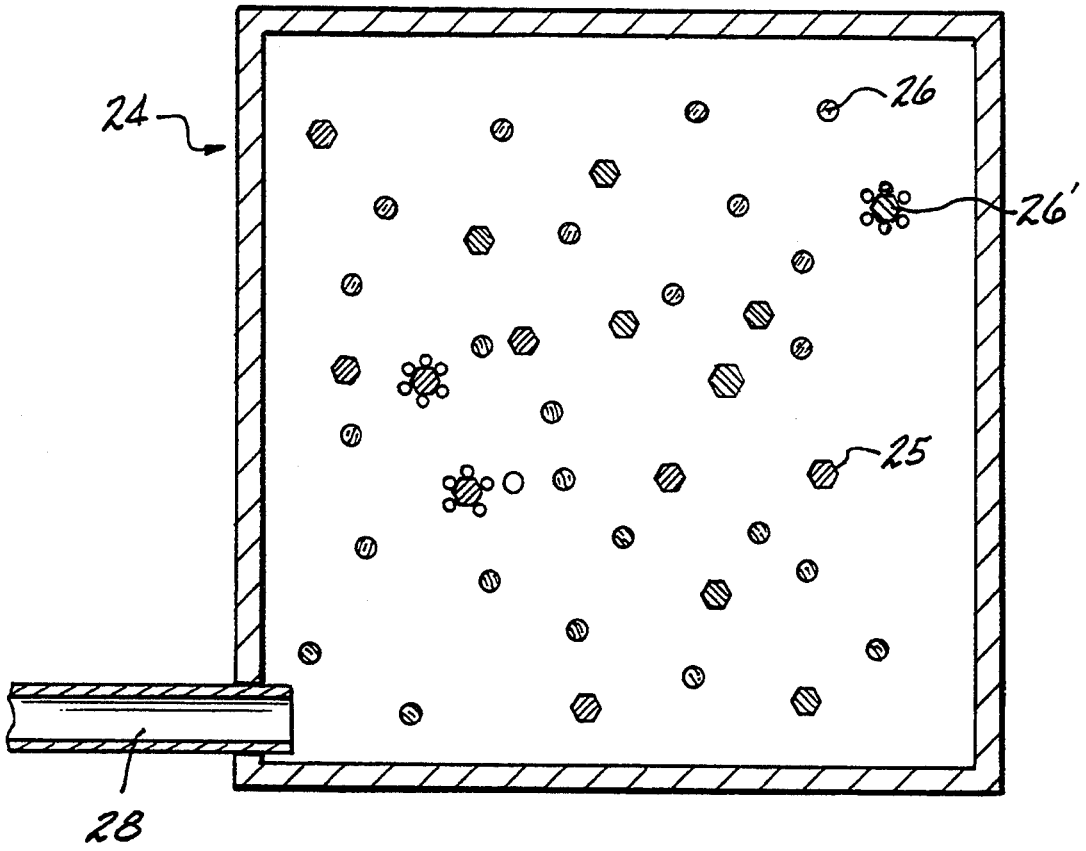
FIG. 4 shows in cross-sectional representation a method for injecting a second phase into atomized droplets of the metal matrix.

A more preferred method to add the reactive element is illustrated in FIG. 4. The reactive element is included as particulate in the second constituent source 24. The reactive element 25 may be provided as additional particles having a size of below about 60 microns (or more preferably below about 45 microns) and injected with the second phase particles into the first constituent atomized melt. The reactive element reacts with copper to form a eutectic which will eliminate porosity, as disclosed in U.S. Pat. No. 4,961,457 to Watson et al, which is incorporated by reference in its entirety herein. Injection of the reactive element particles into the atomized stream through conduit 28 causes partial dissolution of the reactive element with preferential segregation of the reactive element to the last liquid to solidify. The co-segregation of the reactive element and the nitrogen containing pores, a consequence of the insolubility of nitrogen in most copper alloys, produces a fully dense deposit. Dependent on the size of the injected second phase particles 26, the resultant deposit is a fully dense metal matrix composite.

Alternatively, the second phase particles are first mixed with reactive element particles in a mixing device such as an attrition mill. The milling breaks up the second phase particle clusters and embeds or otherwise mechanically adheres the second phase particles to the reactive element particles. The composite particles 26' so produced by the attrition mill can be controlled to an accurate size and density to facilitate injection during spray casting.

Still another alternative is to coat the second phase particles with the reactive element such as by vapor phase deposition.

With reference back to FIG. 1, the atomized mixture of first constituent and injected second constituent, along with the reactive element, is delivered toward and impinged on a continuous substrate system 34 located in spaced relation to the gas atomizer. The continuous substrate system 34 includes a drive means comprising a pair of spaced rollers 36, an endless belt 38 and a series of rollers 40 which underlie and support the endless substrate 38. An area 42 of the substrate 38 directly underlies the divergent pattern of spray. The area 42 receives a deposit of atomized first constituents droplets having second phase particles either adherent on the surface or dispersed therethrough. The droplets splat upon impact with the collector to form a composite metal matrix 44 having a matrix formed of the first constituent with a uniform dispersion of second phase particles.

The endless substrate 38 is formed from any suitable material. To maximize the density of the spray cast composite strip product 44, excessive cooling at the area 42 is minimized by forming the endless substrate 38 from a poor thermal conductor such as a ceramic or an alumina/silicate. The endless substrate 38 may be overlaid with a metallic strip (not shown) such as stainless steel to facilitate removal of the composite strip product 44. This type of collecting system is disclosed in more detail in U.S. Pat. No. 4,917,170 to Ashok et al.

The droplets 23 striking the endless substrate 38 are preferably in a partially solidified state so that solidification occurs shortly after impact. A spray cast matrix having a composition approximately equal to that of the molten stream is formed from a vast multitude of individual droplets. The matrix surrounds the second phase particles forming a coherent composite metal strip of plate product 44 which can be removed from the endless substrate 38 for forming into desired product. Alternatively, rather than a continuous endless substrate, billets or tubes may be formed by collecting the droplets on a rotating cylindrical collector rather than an endless belt. Other types of collectors as known generally in the art may also be utilized to obtain metal matrix composites of various desired configurations.

Particles greater than about 10 microns can be injected routinely during spray casting to produce metal matrix composites. Such is not the case with very fine (on the order of 1 micron) or lower density particles. When the second phase particles 26 have low density, either due to their size or composition, forming a metal matrix composite by spray casting is further hampered by static electricity holding the particles together and by individual second phase particles being expelled from the deposit by the atomizing gas.

Applicants have discovered that the solution to the problems with injection of low density particles is to bond the second phase particles onto the first constituent droplets. This is done by forming a composite second phase particle. The reactive element is mixed with second constituent particles in a device such as an attrition mill. The second constituent particles are mechanically intermixed with the reactive element and when these composite particles are injected, they do not segregate. When the composite particles come in contact with the atomized droplets of the first phase matrix, the reactive element surrounding the low density particles alloys and diffuses into the metal matrix. This allows the low density second phase particles to disperse onto the metal matrix droplets and to be bonded on it until impact with the collector. The deposit thus produced contains the fine, low density second phase particles attached to it and segregation is avoided.

One advantage of the composite particles is the composite particle may be any size by proper selection of the reactive element particle. The second constituent particles can be very small, on the order of less than 1 micron and the composite particle still sufficiently large for injection into the droplets. When the second constituent particles are less than about 0.01 microns, dispersion strengthened copper alloys can be formed.

Figure 5:
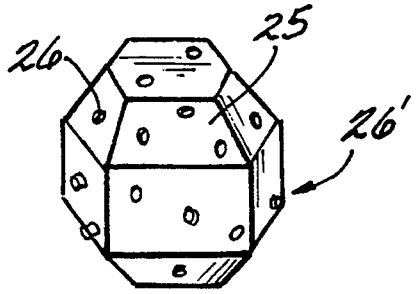
FIG. 5 shows in cross sectional representation a composite second constituent particle in accordance with the invention.

FIG. 5 shows a composite second constituent particle 26'. A reactive element component 25 has a diameter above about 10 microns, suitable for injection into the divergent cone of first constituent droplets. Mechanically intermixed to the reactive element particle 34 are a plurality of second phase particles 24. These second phase particles may be any size, and are preferably of a size effective to dispersion strengthen the metallic matrix. Preferred second phase particles have an average diameter less than about 0.1 microns and preferably less than about 0.01 microns.

The methods of the invention are particularly suited for inclusion of ceramic particles such as alumina or silicon carbide into a copper or copper alloy matrix, such as copper-zirconium, and for inclusion of carbon or graphite particles for fibers into a brass matrix. The inclusion of graphite into a copper alloy matrix is particularly beneficial for potable water applications as disclosed in U.S. Pat. No. 5,137,635 to McDevitt et al, which is incorporated by reference herein. Graphite included in a copper alloy such as a brass, in an effective volume percent, will produce a free machining brass without the inclusion of lead. Particularly in plumbing and other potable water applications, the removal of lead from brass fixtures is highly desirable. The method of the invention provides a way to provide a free machining brass having an effective quantity of graphite dispersed therein rather than a lead phase. A preferred first phase matrix is an alpha-beta brass containing from about 30 to about 58 weight percent zinc and the balance copper. A portion of the zinc and/or the brass may be substituted with other elements for enhanced properties. Graphite forms the second phase dispersion and is present in the composite in an amount of from about 0.1 to about 10 volume percent. A more preferred graphite second phase density is from about 1 to about 5 volume percent.

The reactive element is combined with the graphite prior to injection into the first phase droplets. A suitable amount of reactive element is from about 0.05 to about 5 weight percent, or more preferably at an amount of from about 0.1 to about 3 weight percent. As disclosed in U.S. Pat. Nos. 5,137,635 and 5,288,458 both to McDevitt et al., partial substitutions may be made for a portion of the copper or zinc constituent and additions may be included to influence the properties of the alloy. While any of the reactive elements may be utilized, zirconium is most preferred.

The advantages of the present invention will become more apparent from the example which follows. The example is exemplary and not intended to limit the scope of the invention.

EXAMPLE 1

Carbon fibers having an average diameter of 6 microns and lengths of from 10 to 1000 microns were injected into a stream of copper droplets and collected on a continuous belt collector. The resultant structure illustrated by the micrograph of FIG. 6 at a magnification of 500×, illustrated that 1 percent by volume graphite particles 56 were incorporated into the copper alloy matrix 58. The remainder of the graphite was expelled from the divergent cone of spray cast droplets and accumulated along the walls of the spray deposition apparatus.

When 0.1 weight percent zirconium was added to the graphite particles prior to spray casting, the structure illustrated by the micrograph of FIG. 7, magnification 500×, revealed that the volume density of graphite particles 56 increased to 8 volume percent, an improvement of 800%.

The patents described above are intended to be incorporated by reference in their entirety herein.

It is apparent that there has been provided in accordance with this invention a method for the manufacture of spray cast metal matrix composites and thixotropic composites having improved ductility and higher densities which fully satisfy the objects, means and advantages set forth hereinbefore. While the invention has been described in combination with the specific embodiments thereof, it is evident that many alternatives, modifications and variations will be apparent to those skilled in the art in light of the foregoing description. Accordingly, it is intended to embrace all such alternatives, modifications and variations as fall within the spirit and broad scope of the appended claims.

We claim:

1. A method for producing a metal matrix composite, comprising the steps of:

a) melting a first constituent containing a metal or metallic alloy;

b) flowing said first constituent as a molten stream to an atomizer;

c) atomizing said first constituent into a stream of droplets; and d) injecting a second constituent either into said molten stream or into said stream of droplets, said second constituent containing a mixture of relatively small second phase particles having an average diameter of less than 1 micron and larger reactive metal particles having an average diameter of greater than 5 microns.

2. The method of claim 1 wherein the diameter of said second phase particles is on average less than about 0.1 micron.

3. The method of claim 1 wherein prior to step (d), the second phase particles are mechanically intermixed to the reactive metal particles.

4. The method of claim 3 wherein said first constituent is copper or a copper based alloy.

5. The method of claim 4 wherein said second phase particles are selected from the group consisting of refractory metals, refractory metal alloys and nonmetals.

6. The method of claim 5 wherein said reactive element is selected from the group consisting of zirconium, titanium, chromium and mixtures thereof.

7. The method of claim 6 including selecting said second phase particles to be alumina and said matrix to be a copper alloy containing zirconium.

8. The method of claim 6 including selecting said second phase to be graphite and said first phase is brass.

9. The method of claim 6 wherein the size of said reactive element is from about 5 to about 50 microns.

10. The method of claim 9 wherein said second phase particles have a size less than about 0.01 microns.

* * * * *